US011621139B2

(12) United States Patent
Jeong

(10) Patent No.: US 11,621,139 B2
(45) Date of Patent: Apr. 4, 2023

(54) X-RAY TUBE

(71) Applicant: ELECTRONICS AND TELECOMMUNICATIONS RESEARCH INSTITUTE, Daejeon (KR)

(72) Inventor: Jin-Woo Jeong, Daejeon (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 15 days.

(21) Appl. No.: 17/523,080

(22) Filed: Nov. 10, 2021

(65) Prior Publication Data

US 2022/0148840 A1 May 12, 2022

(30) Foreign Application Priority Data

Nov. 11, 2020 (KR) ..... 10-2020-0150247
Sep. 28, 2021 (KR) ..... 10-2021-0127765

(51) Int. Cl.
*H01J 35/06* (2006.01)
*H01J 35/04* (2006.01)
(Continued)

(52) U.S. Cl.
CPC ..... *H01J 35/065* (2013.01); *H01J 35/045* (2013.01); *H01J 35/101* (2013.01); *H01J 35/105* (2013.01);
(Continued)

(58) Field of Classification Search
CPC ..... H01J 35/065; H01J 35/045; H01J 35/101; H01J 2235/066; H01J 2235/162
See application file for complete search history.

(56) References Cited

U.S. PATENT DOCUMENTS 1,565,969 A * 12/1925 Spiro ..... H01J 35/13 378/142
2009/0304157 A1* 12/2009 Fuerst ..... H01J 3/021 378/122

(Continued)

FOREIGN PATENT DOCUMENTS

KR 10-2010-0123987 A 11/2010
KR 10-2012-0009697 A 2/2012
KR 10-2012256 B1 8/2019

*Primary Examiner* — Chih-Cheng Kao
(74) *Attorney, Agent, or Firm* — Rabin & Berdo, P.C.

(57) ABSTRACT

An X-ray tube according to an embodiment of the inventive concept includes a cathode structure; an anode structure spaced vertically from the cathode structure, a gate electrode structure disposed between the cathode structure and the anode structure, an emitter array disposed between the cathode structure and the gate electrode structure, a tube sheath configured to connect the cathode structure and the anode structure, and a fixing unit connected with the gate electrode structure. The cathode structure includes a first rotation shaft and a cathode connected with the first rotation shaft as one body. The gate electrode structure includes a second rotation shaft and a gate electrode connected with the second rotation shaft through a bearing, and the second rotation shaft is connected with the first rotation shaft by a coupling unit. The gate electrode includes a gate electrode substrate and a protruding part that protrudes from the gate electrode substrate toward an emitter. The protruding part of the gate electrode includes a gate hole that vertically overlaps the emitter. The fixing unit includes a ferromagnetic structure attached to one surface of the gate electrode substrate and disposed on an outer portion of the substrate and a permanent magnet disposed adjacent to the ferromagnetic structure with the tube sheath therebetween.

20 Claims, 4 Drawing Sheets

(51) Int. Cl.
*H01J 35/10* (2006.01)
*H01J 35/16* (2006.01)

(52) U.S. Cl.
CPC ..... *H01J 35/16* (2013.01); *H01J 2235/066* (2013.01); *H01J 2235/1006* (2013.01); *H01J 2235/1204* (2013.01); *H01J 2235/125* (2013.01); *H01J 2235/162* (2013.01); *H01J 2235/167* (2013.01)

(56) References Cited

U.S. PATENT DOCUMENTS

| | | | |
|---|---|---|---|
| 2018/0158640 | A1 | 6/2018 | Choi et al. |
| 2018/0190466 | A1 | 7/2018 | Park et al. |

* cited by examiner

X-RAY TUBE

CROSS-REFERENCE TO RELATED APPLICATIONS

This U.S. non-provisional patent application claims priority under 35 U.S.C. § 119 of Korean Patent Application Nos. 10-2020-0150247, filed on Nov. 11, 2020, and 10-2021-0127765, filed on Sep. 28, 2021, the entire contents of which are hereby incorporated by reference.

BACKGROUND

The present disclosure herein relates to an X-ray tube.

An X-ray tube generates an X-ray such that electrons are generated in a vacuum container, and the electrons are accelerated in a direction of an anode to which a high voltage is applied and collide with a metal target on the anode. Here, a voltage difference between the anode and a cathode is defined as an acceleration voltage for accelerating the electrons. According to purposes of the X-ray tube, the electrons are accelerated with the acceleration voltage of several kV to several hundreds kV. A gate electrode or the like is provided between the anode and the cathode.

SUMMARY

The present disclosure provides an X-ray tube having a predetermined E-beam path.

The present disclosure also provides an X-ray tube capable of effectively dissipating heat generated from an anode structure.

Technical objects to be solved by the present invention are not limited to the aforementioned technical objects and unmentioned technical objects will be clearly understood by those skilled in the art from the description below.

An embodiment of the inventive concept provides an X-ray tube includes: a cathode structure; an anode structure spaced vertically from the cathode structure; a gate electrode structure disposed between the cathode structure and the anode structure; an emitter array disposed between the cathode structure and the gate electrode structure; a tube sheath configured to connect the cathode structure and the anode structure; and a fixing unit connected with the gate electrode structure. Here, the cathode structure includes a first rotation shaft and a cathode connected with the first rotation shaft as one body, the gate electrode structure includes a second rotation shaft and a gate electrode connected with the second rotation shaft through a bearing, wherein the second rotation shaft is connected with the first rotation shaft by a coupling unit, the gate electrode includes a gate electrode substrate and a protruding part that protrudes from the gate electrode substrate toward an emitter, the protruding part of the gate electrode includes a gate hole that vertically overlaps the emitter, and the fixing unit includes: a ferromagnetic structure attached to one surface of the gate electrode substrate and disposed on an outer portion of the substrate; and a permanent magnet disposed adjacent to the ferromagnetic structure with the tube sheath therebetween.

In an embodiment, the cathode structure, the anode structure, and the second rotation shaft may rotate in one direction, and the gate electrode may not rotate.

In an embodiment, the first rotation shaft may have a tube shape, and the second rotation shaft may be disposed in an inner space of the first rotation shaft.

In an embodiment, the gate electrode substrate may have a circular plate shape, and the emitter array may have a track shape within a range between diameters of two concentric circles.

In an embodiment, the emitter array may be disposed on a top surface of the cathode and rotate together with the cathode.

In an embodiment, the emitter array may include a carbon nano-tube (CNT).

In an embodiment, the X-ray tube may further include an insulation spacer spaced vertically from the cathode structure, the anode structure may pass through the insulation spacer, the anode structure may include a heat dissipation part, a target part, and a connection part configured to connect the heat dissipation part and the target part, the target part may be disposed closer to the cathode than the heat dissipation part, and the heat dissipation part may be spaced apart from the target part with the insulation spacer therebetween.

In an embodiment, the heat dissipation part may include a heat dissipation fin.

In an embodiment, the second rotation shaft may pass through a central portion of the gate electrode substrate, the second rotation shaft may include an extension part that extends in a horizontal direction, and the bearing may be disposed between the extension part and the gate electrode substrate.

In an embodiment, the bearing may be a first bearing, and the X-ray tube may further include a plate connected to an upper portion of the second rotation shaft and a second bearing disposed between the plate and the gate electrode substrate to surround the second rotation shaft.

In an embodiment of the inventive concept, an X-ray tube includes: a cathode structure; an insulation spacer spaced vertically from the cathode structure; an anode structure that passes through the insulation spacer; a gate electrode structure disposed between the cathode structure and the anode structure; an emitter array disposed between the cathode structure and the gate electrode structure; a tube sheath configured to connect the cathode structure and the anode structure; and a fixing unit connected with the gate electrode structure. Here, the cathode structure includes a first rotation shaft and a cathode connected with the first rotation shaft as one body, the gate electrode structure includes a second rotation shaft and a gate electrode connected with the second rotation shaft through a bearing, the gate electrode includes a gate electrode substrate and a protruding part that protrudes from the gate electrode substrate toward an emitter, the protruding part of the gate electrode includes a gate hole that vertically overlaps the emitter, the anode structure includes a heat dissipation part, a target part, and a connection part configured to connect the heat dissipation part and the target part, the target part is disposed closer to the cathode than the heat dissipation part, and the heat dissipation part is spaced apart from the target part with the insulation spacer therebetween.

In an embodiment, an X-ray may be generated by emitting an E-beam generated from a partial emitter group of the emitter array, which faces the protruding part of the gate electrode, to the target part through the hole of the protruding part based on a voltage difference between the cathode and the gate electrode.

In an embodiment, the cathode structure, the anode structure, and the second rotation shaft may rotate in one direction, and the gate electrode may not rotate.

In an embodiment, the X-ray may be generated from only a predetermined area of the target part, and the predetermined area may have a ring shape.

In an embodiment, a portion of the connection part, which is disposed above the insulation spacer, and the heat dissipation part may contact a cooling unit In an embodiment, the cooling unit may be insulating oil.

In an embodiment, the second rotation shaft may pass through a central portion of the gate electrode substrate, the second rotation shaft may include an extension part that extends in a horizontal direction, and the bearing may be disposed between the extension part and the gate electrode substrate.

In an embodiment of the inventive concept, an X-ray tube includes: a cathode structure; an anode structure spaced vertically from the cathode structure; a gate electrode structure disposed between the cathode structure and the anode structure; an emitter array disposed between the cathode structure and the gate electrode structure; a tube sheath configured to connect the cathode structure and the anode structure; and a fixing unit connected with the gate electrode structure. Here, the cathode structure includes a first rotation shaft and a cathode connected with the first rotation shaft as one body, the gate electrode structure includes a second rotation shaft and a gate electrode connected with the second rotation shaft through a bearing, wherein the second rotation shaft is connected with the first rotation shaft by a coupling unit, the gate electrode includes a gate electrode substrate and a protruding part that protrudes from the gate electrode substrate toward an emitter, the protruding part of the gate electrode includes a gate hole that vertically overlaps the emitter, the cathode structure, the anode structure, and the second rotation shaft rotate in one direction, and the gate electrode does not rotate.

In an embodiment, the first rotation shaft may have a tube shape, and the second rotation shaft may be disposed in an inner space of the first rotation shaft.

In an embodiment, the gate electrode substrate may have a circular plate shape, and the emitter array may have a track shape within a range between diameters of two concentric circles.

BRIEF DESCRIPTION OF THE FIGURES

The accompanying drawings are included to provide a further understanding of the inventive concept, and are incorporated in and constitute a part of this specification. The drawings illustrate embodiments of the inventive concept and, together with the description, serve to explain principles of the inventive concept. In the drawings.

DETAILED DESCRIPTION

Exemplary embodiments of the present invention will be described with reference to the accompanying drawings so as to sufficiently understand constitutions and effects of the present invention. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Further, the present invention is only defined by scopes of claims. In addition, the sizes of the elements and the relative sizes between elements may be exaggerated for further understanding of the present invention.

Figure 1:
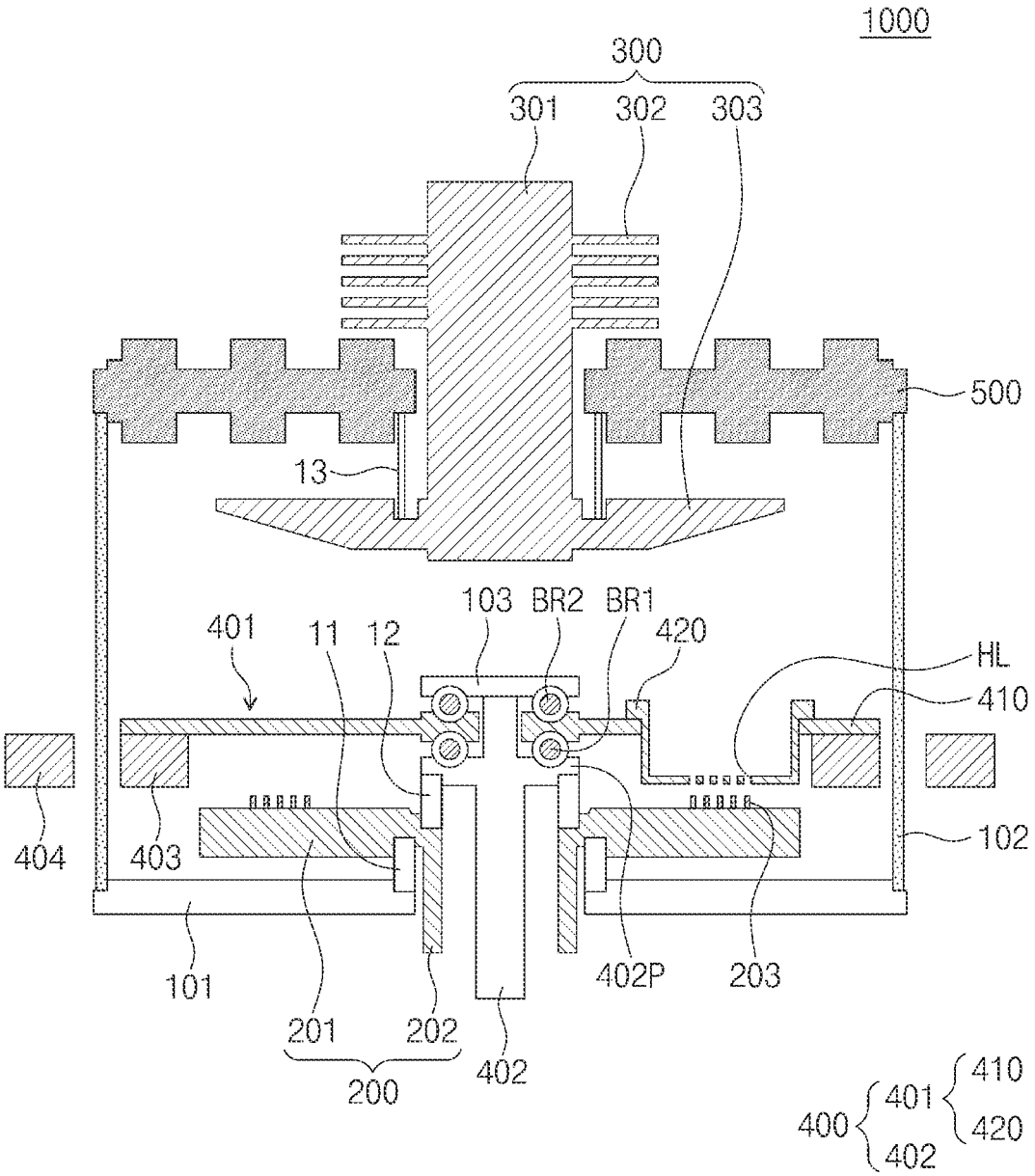
FIG. 1 is a cross-sectional view illustrating an X-ray tube according to an embodiment of the inventive concept.
Figure 2:
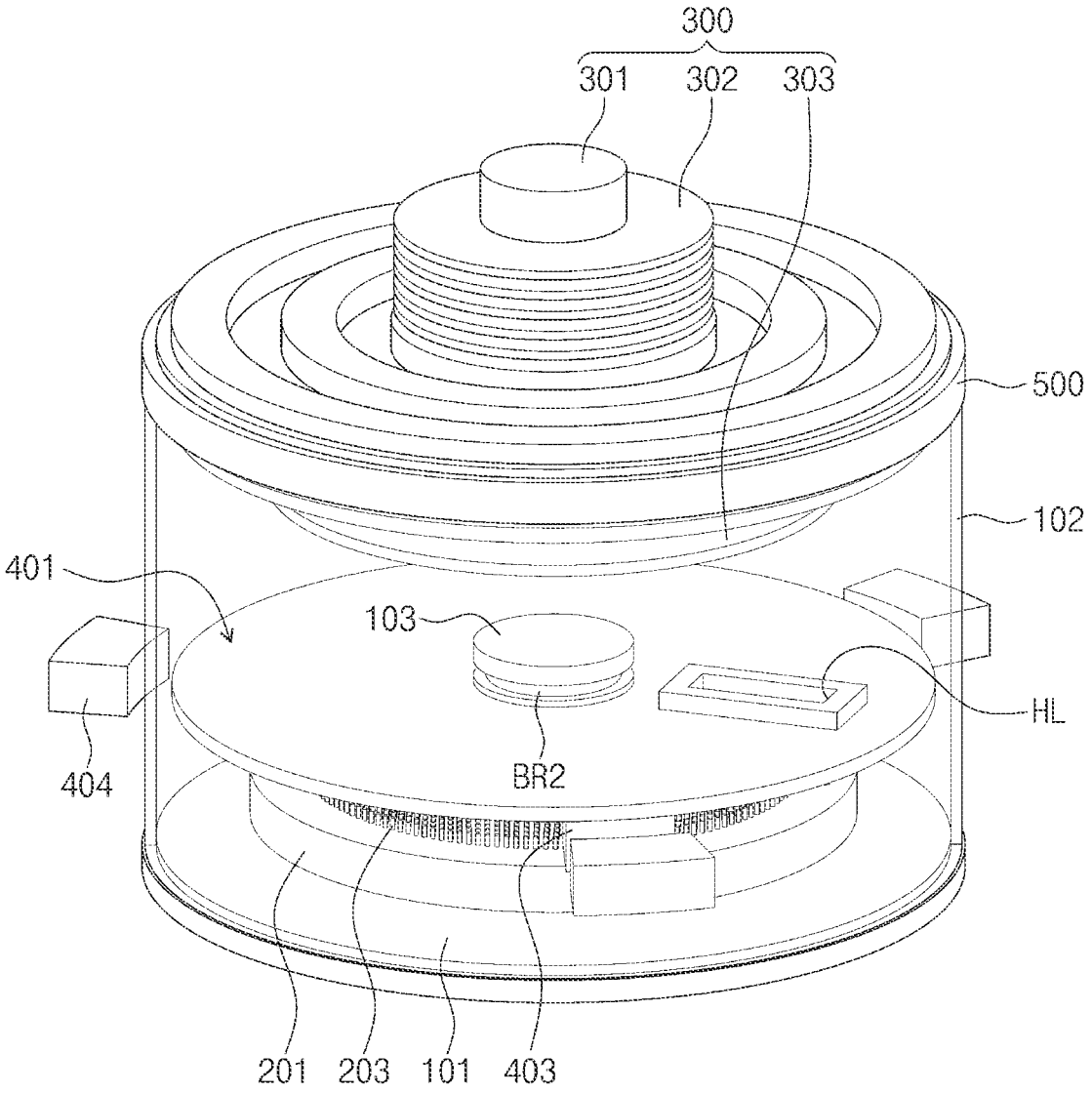
FIG. 2 is a perspective view illustrating the X-ray tube of FIG. 1.
Figure 3:
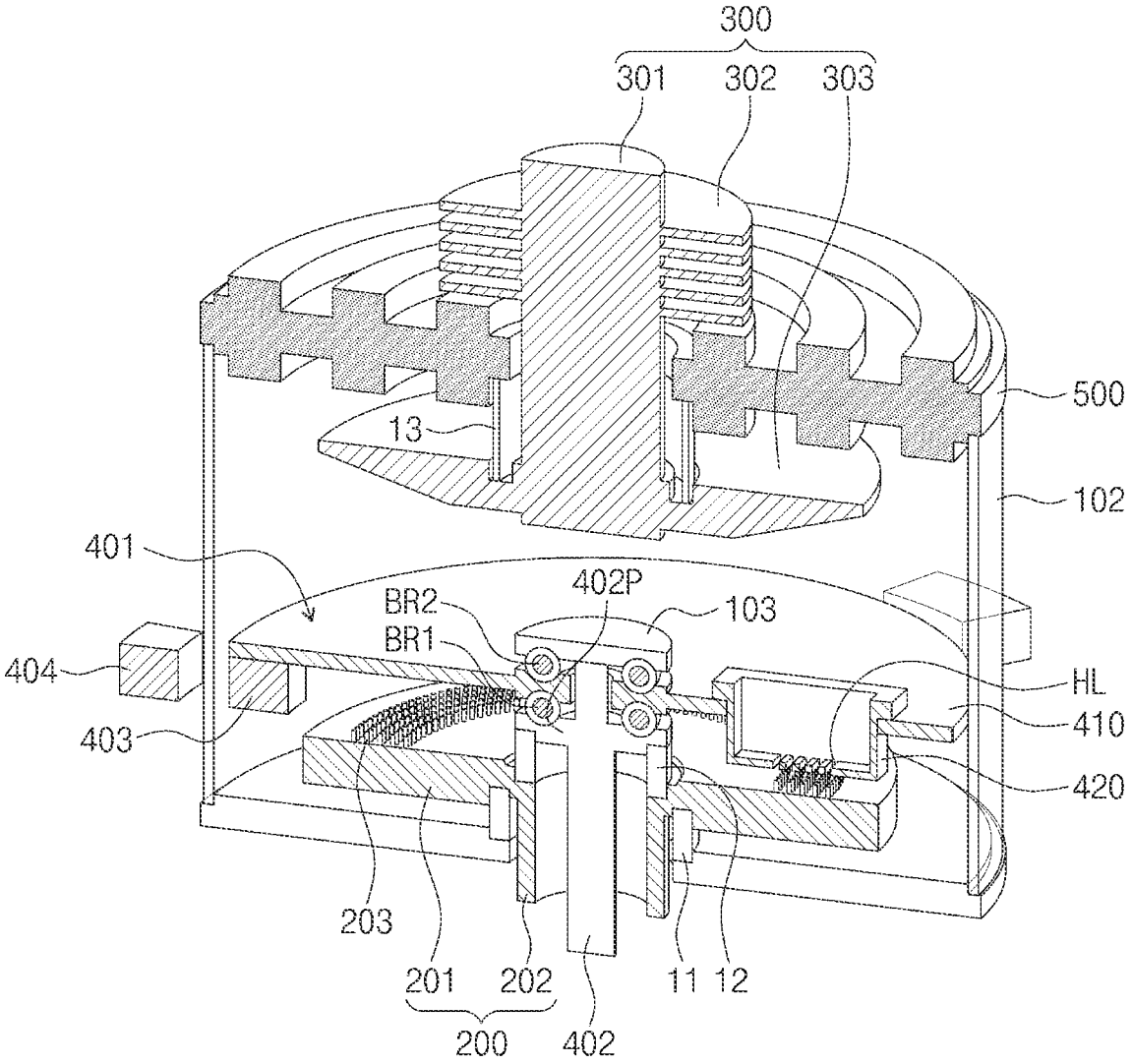
FIG. 3 is a perspective cross-sectional view illustrating the X-ray tube of FIG. 2.

FIG. 1 is a cross-sectional view illustrating an X-ray tube according to an embodiment of the inventive concept. FIG. 2 is a perspective view illustrating the X-ray tube of FIG. 1. FIG. 3 is a perspective cross-sectional view illustrating the X-ray tube of FIG. 2.

Referring to FIGS. 1 to 3, an X-ray tube 1000 according to an embodiment of the inventive concept may include a base substrate 101, a cathode structure 200, an anode structure 300, a gate electrode structure 400, an emitter array 203, a tube sheath 102, an insulation spacer 500, a ferromagnetic structure 403, and a permanent magnet 404.

The base substrate 101 may be disposed at one end of the X-ray tube 1000. For example, the base substrate 101 may contain a metal material.

The cathode structure 200 may include a cathode 201 and a first rotation shaft 202. The cathode 201 may be disposed on the base substrate 101. The cathode 201 may contact a top surface of the base substrate 101. Also, as illustrated, the cathode 201 may be coupled to the base substrate 101 through a first coupling unit 11. For example, the first coupling unit 11 may contain an insulating material. The first rotation shaft 202 may pass through the base substrate 101 and be connected with the cathode 201 as one body. The first rotation shaft 202 may have a hollow tube shape.

The emitter array 203 may be disposed on the cathode 201. The emitter array 203 may have a track shape within a range between diameters of two concentric circles. The emitter array 203 may include a plurality of emitters, and each of the emitters may be one of a carbon nano-tube (CNT), graphene, a nano-fiber, a nano-rod, a nano-needle, or a nano-pin.

The anode structure 300 may be disposed above the cathode structure 200. The anode structure 300 may include a target part 303, a heat dissipation part 302, and a connection part 301 connecting the target part 303 and the heat dissipation part 302. A bottom surface of the target part 303, i.e., a surface of the target part 303, which faces a gate electrode 401, may be inclined. The heat dissipation part 302 may have, e.g., a heat dissipation fin shape.

The gate electrode structure 400 may include a gate electrode 401 and a second rotation shaft 402. A gate electrode 401 may be disposed between the cathode 201 and the target part 303. The gate electrode 401 may be disposed closer to the cathode 201 than the anode structure 300.

The gate electrode 401 may include a gate electrode substrate 410 and a protruding part 420 protruding from the gate electrode substrate 410 toward the emitter array 203. The gate electrode substrate 410 may have, e.g., a circular plate shape, and a central portion thereof may pass through the second rotation shaft 402 that will be described later. The protruding part 420 of the gate electrode 401 may include a gate hole HL, and the gate hole HL may vertically overlap the emitter array 203. That is, the emitters overlapping the gate hole HL may be exposed. The gate hole HL may be provided in plurality. In some embodiments, the gate hole HL may have a mesh shape.

The second rotation shaft 402 may be disposed in an inner space of the first rotation shaft 202. The second rotation shaft 402 may have an extension part 402P extending in a horizontal direction. A first bearing BR1 may be disposed between the extension part 402P of the second rotation shaft 402 and the gate electrode substrate 410.

A plate 103 connected with the second rotation shaft 402 may be disposed on the second rotation shaft 402. A second bearing BR2 may be disposed between the plate 103 and the gate electrode substrate 410. That is, the second rotation shaft 402 may be connected with the gate electrode 401 through the first bearing BR1 and the second bearing BR2. The second rotation shaft 402 may be coupled with the first rotation shaft 202 through a second coupling unit 12. The second coupling unit 12 may be disposed between the extension part 402P of the second rotation shaft 402 and the first rotation shaft 202. For example, the second coupling unit 12 may contain an insulating material.

Each of the cathode structure 200, the anode structure 300, and the gate electrode structure 400 may include an alloy material such as stainless steel (SUS) and Kovar and a metal material such as copper (Cu), aluminum (Al), and molybdenum (Mo).

The insulation spacer 500 surrounding the connection part 301 may be disposed between the heat dissipation part 302 and the target part 303 of the anode structure 300. The insulation spacer 500 may be disposed at the other end of the X-ray tube 100 based on the base substrate 101. The insulation spacer 500 may contain a ceramic material.

A third coupling unit 13 for coupling the insulation spacer 500 and the anode structure 300 may be provided. The third coupling unit 13 may be disposed between the insulation spacer 500 and the target part 303. For example, the third coupling unit 13 may contain a metal material.

The tube sheath 102 may have a tube shape having opened upper and lower portions. The tube sheath 102 may surround the cathode 201, the target part 303, and the gate electrode 401. The tube sheath 102 may be coupled with an outer portion of the top surface of the base substrate 101 and an outer portion of a bottom surface of the insulation spacer 500. The tube sheath 102 may contain a material that is solid even in a vacuum state. For example, the tube sheath 102 may contain a material transmitting a magnetic field with little attenuation or without attenuation.

The ferromagnetic structure 403 may be disposed on an outer portion of a bottom surface of the gate electrode 401. According to some embodiments, the ferromagnetic structure 403 may be disposed on an outer portion of a top surface of the gate electrode 401. The ferromagnetic structure 403 may contain a ferromagnetic material such as iron (Fe), cobalt (Co), nickel (Ni), and tungsten (W).

The permanent magnet 404 may be disposed adjacent to the ferromagnetic structure 403 with the tube sheath 102 therebetween. The permanent magnet 404 may include one of a metal magnet and a ceramic magnet. The metal magnet may contain a rare-earth alloy or an alloy of nickel, metal, aluminum, and cobalt. The ceramic magnet may contain an alloy of ferrite, manganese, cobalt, and nickel.

Figure 4:
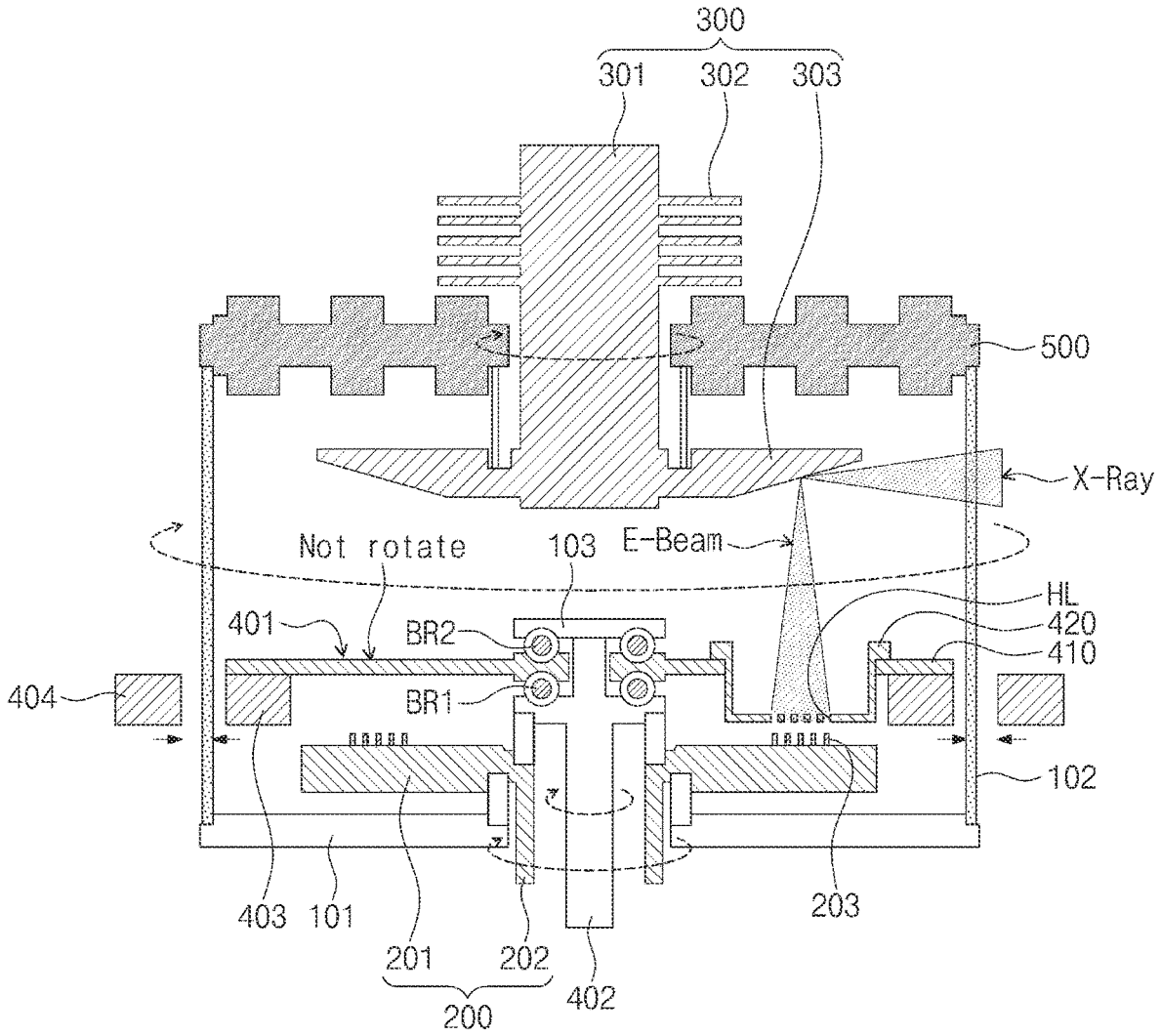
FIG. 4 is a conceptual view illustrating an operation state of the X-ray tube.

FIG. 4 is a conceptual view illustrating an operation state of each of components of the X-ray tube.

Referring to FIG. 4, the cathode structure 200, the anode structure 300, and the gate electrode 401 may be electrically connected to an external power (not shown). For example, a positive voltage or a negative voltage may be applied to the cathode structure 200, or a ground power may be connected to the cathode structure 200. A voltage having a potential greater than that of the cathode structure 200 may be applied to each of the anode structure 300 and the gate electrode 401.

The protruding part 420 of the gate electrode 401 may allow an emitter group adjacent thereto among the emitter array 203 to selectively emit an E-beam. That is, although the same voltage is applied to the gate electrode substrate 410 and the protruding part 420 of the gate electrode 401, since the protruding part 420 and the emitter array 203 are disposed closer in position, an electronic field having an intensity capable of generating an E-beam therebetween may be generated.

The E-beam emitted from the emitter may be generated and accelerated in a vacuum state. The E-beam emitted from the emitter may pass through the gate hole HL of the gate electrode 401 and be concentrated to the target part 303. The E-beam may collide with the target part 303 to generate an X-ray.

The first rotation shaft 202 may be connected with an external rotation power (e.g., a motor) to rotate in one direction. The cathode 201 may rotate together by the first rotation shaft 202. The base substrate 101, the tube sheath 102, the insulation spacer 500, the anode structure 300, and the second rotation shaft 402 may rotate together by the rotation of the first rotation shaft 202. According to some embodiments, the second rotation shaft 402 may be connected with an external rotation power, and the first rotation shaft 202, the cathode 201, the base substrate 101, the tube sheath 102, the insulation spacer 500, the anode structure 300, and the second rotation shaft 402 may rotate together by rotation of the second rotation shaft 402.

According to an embodiment of the inventive concept, the gate electrode 401 may be fixed instead of rotating like other electrode structures 200 and 300. The gate electrode 401 may not rotate independently through the first bearing BR1 and the second bearing BR2 although the second rotation shaft 402 rotates. The gate electrode 401 may be fixed by a strong attractive force between the permanent magnet 404 and the ferromagnetic structure 403 instead of moving. As the gate electrode 401 is fixed (instead of rotating), the E-beam may travel at a predetermined position with a predetermined path. Also, since a time for E-beam emission of each of the emitters is reduced as the emitters disposed adjacent to face the protruding part 420 of the gate electrode 401 are changed consecutively in time, an overall lifespan of the emitter array may increase. As a result, reliability of the X-ray tube may increase.

According to an embodiment of the inventive concept, the anode structure 300 may include a portion of the connection part 301 and the heat dissipation part 302, which protrude to the outside of the insulation spacer 500. The portion of the connection part 301 and the heat dissipation part 302 may be disposed in an outer space instead of a vacuum inner space defined by the tube sheath 102. The portion of the connection part 301 and the heat dissipation part 302 may contact a cooling unit. For example, the cooling unit may be insulating oil. The anode structure 300 may be directly connected with the external cooling unit to effectively remove heat generated from the target part 303.

In the X-ray tube according to the embodiments of the inventive concept, the cathode structure and the anode structure rotate while the gate electrode does not rotate. The emitter array disposed on the cathode structure may have the concentric circle shape, and the gate electrode may have the protruding part that protrudes toward the emitter array. While the emitter array rotates together with the cathode, the emitters adjacent to the protruding part of the gate electrode may selectively emit the E-beam. As the gate electrode is fixed, the E-beam may travel at the predetermined position with the predetermined path. Also, in the X-ray tube according to the embodiments of the inventive concept, a portion of the anode structure may be disposed at the outside of the space defined by the tube sheath. As the portion of the anode structure is connected with the external cooling unit, the heat generated from the anode structure may be effectively dissipated.

Although the embodiments of the present invention have been described, it is understood that the present invention should not be limited to these embodiments but various changes and modifications can be made by one ordinary skilled in the art within the spirit and scope of the present invention as hereinafter claimed. Therefore, it is understood that the embodiments described above are illustrative in all respects and not restrictive.

What is claimed is:

1. An X-ray tube comprising:

a cathode structure;

an anode structure spaced vertically from the cathode structure;

a gate electrode structure disposed between the cathode structure and the anode structure;

an emitter array disposed between the cathode structure and the gate electrode structure;

a tube sheath configured to connect the cathode structure and the anode structure; and a fixing unit connected with the gate electrode structure, wherein the cathode structure comprises a first rotation shaft and a cathode connected with the first rotation shaft as one body, the gate electrode structure comprises a second rotation shaft and a gate electrode connected with the second rotation shaft through a bearing, wherein the second rotation shaft is connected with the first rotation shaft by a coupling unit, the gate electrode comprises a gate electrode substrate and a protruding part that protrudes from the gate electrode substrate toward an emitter, the protruding part of the gate electrode comprises a gate hole that vertically overlaps the emitter, and the fixing unit comprises:

a ferromagnetic structure attached to one surface of the gate electrode substrate and disposed on an outer portion of the substrate; and a permanent magnet disposed adjacent to the ferromagnetic structure with the tube sheath therebetween.

2. The X-ray tube of claim 1, wherein the cathode structure, the anode structure, and the second rotation shaft rotate in one direction, wherein the gate electrode does not rotate.

3. The X-ray tube of claim 1, wherein the first rotation shaft has a tube shape, and the second rotation shaft is disposed in an inner space of the first rotation shaft.

4. The X-ray tube of claim 1, wherein the gate electrode substrate has a circular plate shape, and the emitter array has a track shape within a range between diameters of two concentric circles.

5. The X-ray tube of claim 1, wherein the emitter array is disposed on a top surface of the cathode and rotates together with the cathode.

6. The X-ray tube of claim 1, wherein the emitter array comprises a carbon nano-tube (CNT).

7. The X-ray tube of claim 1, further comprising an insulation spacer spaced vertically from the cathode structure, wherein the anode structure passes through the insulation spacer, the anode structure comprises a heat dissipation part, a target part, and a connection part configured to connect the heat dissipation part and the target part, the target part is disposed closer to the cathode than the heat dissipation part, and the heat dissipation part is spaced apart from the target part with the insulation spacer therebetween.

8. The X-ray tube of claim 7, wherein the heat dissipation part comprises a heat dissipation fin.

9. The X-ray tube of claim 1, wherein the second rotation shaft passes through a central portion of the gate electrode substrate, the second rotation shaft comprises an extension part that extends in a horizontal direction, and the bearing is disposed between the extension part and the gate electrode substrate.

10. The X-ray tube of claim 9, wherein the bearing is a first bearing, and the X-ray tube further comprises a plate connected to an upper portion of the second rotation shaft and a second bearing disposed between the plate and the gate electrode substrate to surround the second rotation shaft.

11. An X-ray tube comprising:

a cathode structure;

an insulation spacer spaced vertically from the cathode structure;

an anode structure that passes through the insulation spacer;

a gate electrode structure disposed between the cathode structure and the anode structure;

an emitter array disposed between the cathode structure and the gate electrode structure;

a tube sheath configured to connect the cathode structure and the anode structure; and a fixing unit connected with the gate electrode structure, wherein the cathode structure comprises a first rotation shaft and a cathode connected with the first rotation shaft as one body, the gate electrode structure comprises a second rotation shaft and a gate electrode connected with the second rotation shaft through a bearing, the gate electrode comprises a gate electrode substrate and a protruding part that protrudes from the gate electrode substrate toward an emitter, the protruding part of the gate electrode comprises a gate hole that vertically overlaps the emitter, the anode structure comprises a heat dissipation part, a target part, and a connection part configured to connect the heat dissipation part and the target part, the target part is disposed closer to the cathode than the heat dissipation part, and the heat dissipation part is spaced apart from the target part with the insulation spacer therebetween.

12. The X-ray tube of claim 11, wherein an X-ray is generated by emitting an E-beam generated from a partial emitter group of the emitter array, which faces the protruding part of the gate electrode, to the target part through the hole of the protruding part based on a voltage difference between the cathode and the gate electrode.

13. The X-ray tube of claim 12, wherein the cathode structure, the anode structure, and the second rotation shaft rotate in one direction, wherein the gate electrode does not rotate.

14. The X-ray tube of claim 13, wherein the X-ray is generated from only a predetermined area of the target part, and the predetermined area has a ring shape.

15. The X-ray tube of claim 11, wherein a portion of the connection part, which is disposed above the insulation spacer, and the heat dissipation part contact a cooling unit.

16. The X-ray tube of claim 15, wherein the cooling unit is insulating oil.

17. The X-ray tube of claim 11, wherein the second rotation shaft passes through a central portion of the gate electrode substrate, the second rotation shaft comprises an extension part that extends in a horizontal direction, and the bearing is disposed between the extension part and the gate electrode substrate.

18. An X-ray tube comprising:

a cathode structure;

an anode structure spaced vertically from the cathode structure;

a gate electrode structure disposed between the cathode structure and the anode structure;

an emitter array disposed between the cathode structure and the gate electrode structure;

a tube sheath configured to connect the cathode structure and the anode structure; and a fixing unit connected with the gate electrode structure, wherein the cathode structure comprises a first rotation shaft and a cathode connected with the first rotation shaft as one body, the gate electrode structure comprises a second rotation shaft and a gate electrode connected with the second rotation shaft through a bearing, wherein the second rotation shaft is connected with the first rotation shaft by a coupling unit, the gate electrode comprises a gate electrode substrate and a protruding part that protrudes from the gate electrode substrate toward an emitter, the protruding part of the gate electrode comprises a gate hole that vertically overlaps the emitter, and the cathode structure, the anode structure, and the second rotation shaft rotate in one direction, wherein the gate electrode does not rotate.

19. The X-ray tube of claim 18, wherein the first rotation shaft has a tube shape, and the second rotation shaft is disposed in an inner space of the first rotation shaft.

20. The X-ray tube of claim 18, wherein the gate electrode substrate has a circular plate shape, and the emitter array has a track shape within a range between diameters of two concentric circles.

* * * * *